United States Patent [19]

Eckert et al.

[11] Patent Number: 4,613,734

[45] Date of Patent: Sep. 23, 1986

[54] RESILIENT CLAMPING DEVICE FOR SECURING AN ARC CHUTE COVER OF A SWITCHING DEVICE

[75] Inventors: Guenther Eckert, Maxhuette-Haidhof; Franz Singer, Amberg, both of Fed. Rep. of Germany

[73] Assignee: Siemens Aktiengesellschaft, Munich and Berlin, Fed. Rep. of Germany

[21] Appl. No.: 710,092

[22] Filed: Mar. 11, 1985

[30] Foreign Application Priority Data

Mar. 15, 1984 [DE] Fed. Rep. of Germany ..... 3409579

[51] Int. Cl.[4] ..... H01H 33/00; H01H 9/02

[52] U.S. Cl. ..... 200/144 R; 200/293; 200/295; 200/302.1

[58] Field of Search ..... 200/144 R, 293, 294, 200/295, 296, 297, 298, 301, 302.1

[56] References Cited

U.S. PATENT DOCUMENTS

| | | | |
|---|---|---|---|
| 2,337,809 | 12/1943 | Gaynor | 200/153 W |
| 3,538,286 | 11/1970 | Michaelson, Jr. | 200/294 |

FOREIGN PATENT DOCUMENTS

| | | | |
|---|---|---|---|
| 1077296 | 3/1960 | Fed. Rep. of Germany | 200/144 R |
| 7522823 | 7/1975 | Fed. Rep. of Germany | 200/144 R |
| 2344945 | 10/1977 | France | 200/302.1 |
| 6514277 | 6/1966 | Netherlands | 200/153 W |

*Primary Examiner*—Robert S. Macon

*Attorney, Agent, or Firm*—F. W. Powers; J. L. James; J. R. Penrod

[57] ABSTRACT

The invention concerns a mounting arrangement for an arc-quenching chute cover upon a base of a switching device. For that purpose it includes resilient clamping elements, such as a quick-release fastener which guides a coil spring and a rubber bushing. The anchoring of the quick-release fastener in the base is achieved by twisting a pin into a widened region. When excess pressures arise inside the arc-quenching chute cover, the rubber bushing is compressed and has a damping effect on the shaft portion of the quick-release fastener passing through it.

10 Claims, 1 Drawing Figure

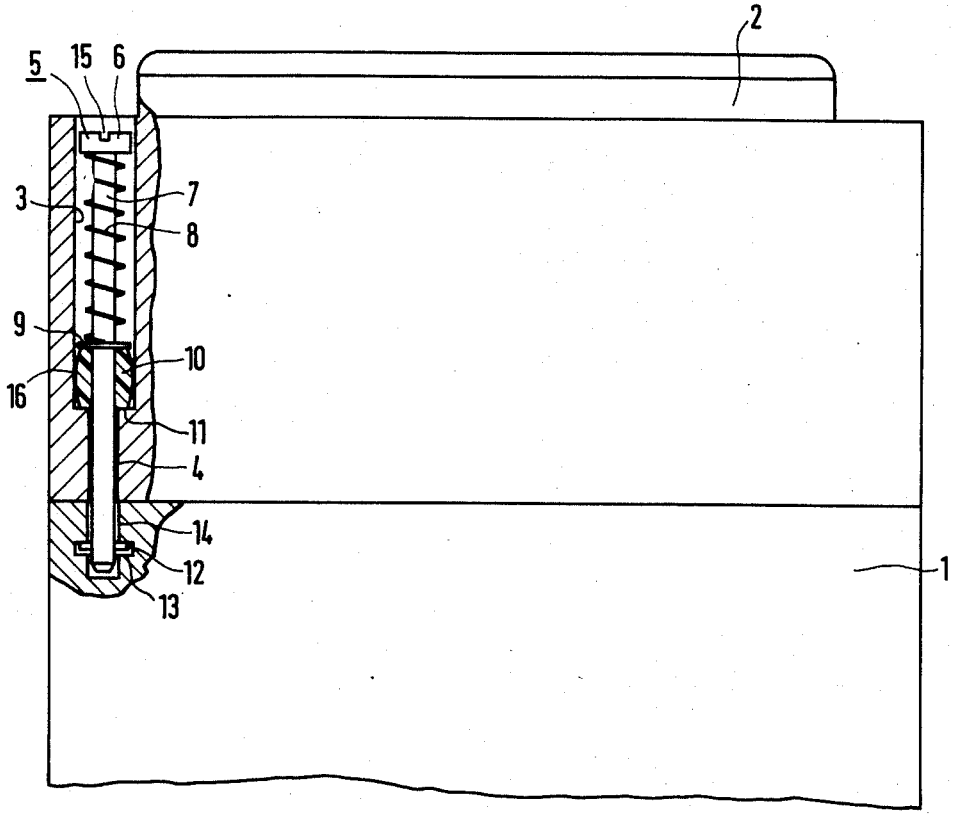
2
5
15
6
3
7
8
9
10
16
11
4
14
12
13
1

RESILIENT CLAMPING DEVICE FOR SECURING AN ARC CHUTE COVER OF A SWITCHING DEVICE

BACKGROUND OF THE INVENTION

This invention relates to electrical switching devices and more particularly to electrical switching devices with arc chute covers which are resiliently and yieldingly clamped by a clamping device.

In known arrangements of the above type (DE-GM 75 22 823, DE-AS 1 077 296) arc chute covers are pressed onto bases by means of springs. In the first case, a helical spring is guided in each case over a quick release fastener. In the second case, a leaf spring is used for pressing cover and base together. The springs provided in both cases can certainly compensate for tolerances in the manufacturing of the arc chute covers, so as to avoid damage to the chute covers during securement, but they cannot be used, at least not satisfactorily, for allowing the chute cover to breath, i.e. for allowing the arc chute covers to lift for a short time from the base part when high excess pressures occur due to arcing. If the spring were to be of weak construction, then when there is a great excess pressure the spring would be compressed flat almost immediately, unable to absorb further pressure and the resulting impact exerted on the arc chute cover could cause damage to the cover. If, on the other hand, the spring is made too rigid, then the actuation force for locking the arcing chamber is too great and no relief can be expected when there are only low excess pressures.

It is an object of this invention to provide an arc chute cover for a switching device which is secured in such a manner as to reduce excess pressures from arc heated switching gases. It is a furthr object of this invention to provide relief from excess pressures of arc heated gases without damaging the arc chute cover or the clamping device holding the cover to the base.

SUMMARY OF THE INVENTION

Briefly stated, in accordance with one aspect of the invention, the foregoing objects are achieved by providing an arc chute cover connected to a base by one or more resilient clamping devices which yieldingly connects the arc chute cover to the base. The clamping devices yieldingly connect the cover to the base to allow relief of excess pressure during arcing.

BRIEF DESCRIPTION OF THE DRAWING

While the specification concludes with claims particularly pointing out and distinctly claiming the subject matter which is regarded as the invention, it is believed that the invention will be better understood from the following description of the preferred embodiment taken in conjunction with the accompanying drawing in which the figure illustrates a partially cut away front view of the assembled switching device.

DESCRIPTION OF A PREFERRED EMBODIMENT

As shown in the drawing, there is provided an arc chute cover of a switching device which comprises a base 1 and an arc chute cover 2 connected to the base 1. At least one resilient clamping device is provided which yieldingly connects together the cover 2 and the base 1.

In the side region of the cover, there are one or more cylindrical recesses or holes 3, which merge into corresponding narrower cylindrical holes or recesses 4, whereby a shoulder or transition is provided which permits the insertion of a quick-release fastener. The fastener 5 has a slotted head 6 at one end, and is provided with a quick release fitting in the form of a transverse pin 12 at its opposite end.

The fastener 5 forms a resilient clamping device, with two resiliently deformable members which are fitted on the shaft 7 of the fastener 5, and which have different resilient properties. One resiliently deformable member comprises a helical compression spring 8 through which the shaft 7 extends, and the other resiliently deformable member comprises a block of elastomeric material in the form of a bushing 10 also fitted on the shaft 7. The helical compression spring 8 is more resilient, i.e. more readily deformed than the bushing 10, whereby upon relative separation of the cover 2 and the base 1, yielding of this spring 8 is initially caused in advance of any yielding of the less resilient member, namely the bushing 10.

The bushing 10 is made preferably of siloprene, (silicone rubber) or EPDM (ethylene-propylene-diolefin rubber). Also, as will be seen from the drawing, the external surface of the bushing 10 is barrel-shaped. A washer 9 is interposed between the helical compression spring 8, and the bushing 10. In addition, the bushing 10 rests at its lower end on a lower limit or shoulder 11 of the cylindrical recess 3. The helical compression spring 8 engages with the underside of the slotted head 6.

The formation of the fastener is completed by insertion of the laterally extending pin 12 so as to form a quick release fastener. A keyway for the pin 12 is the base part 1, and if need be in the arcing chute cover also, are not shown in detail. A widening 13 of an aligned hole or recess 14 in the base widening 1 is used for locking the latching pin 5 in the clamp state, i.e. by the insertion of a screwdriver into a slot 15 in the slotted head 6, and exertion of pressure in the direction of the longitudinal axis of the quick release fastener, i.e. in the clamping direction of the spring 8, and by rotation through 90 degrees so that the pin 12 comes into engagement with the widening 13, so that the arc chute cover is firmly held onto the base part 1.

If an excess pressure should be generated inside the arc chute cover, following a switching action, then first of all, lifting of the arc chute cover and hence removal of the excess pressure is made possible by compressing the helical compression spring 8. If the excess pressure should be such that the spring 8 is fully compressed to an effectively flat state, then further lifting is still permitted (thereby preventing damage to the parts of the chute cover or the clamping devices) by virtue of the ability for the bushing or block 10 to deform. Deformation of the bushing 10 provides for damping of the lifting-off movement of the cover 2, thereby preventing damage to the arcing chamber. During deformation of the bushing 10, by virtue of its undeformed, over-sized outer diameter, relative to the portion of the hole 3 in which it is received, the outer surface of the bushing 10 engages with the inner wall 16 of the recess 3. Also provided is a friction damping during movement of the fastener shaft 7 through the rubber bushing 10, since the rubber bushing 10 reduces its inner diameter while it is compressed.

Preferaby, the bushing is made from EPDM (ethylene-propylene-diolefin-rubber) or siloprene (silicone rubber). However, silicone rubber has proved to be particularly advantageous. Conveniently, the bushing is formed so that its external surface is barrel-shaped, whereby the desired spring and damping characteristics of the rubber bushing can be easily established in advance. As will be evident from the foregoing description, certain aspects of the invention are not limited to the particular details of the examples illustrated, and it is therefore contemplated that other modifications or applications wil occur to those skilled in the art. It is accordingly intended that the claims shall cover all such modifications and applications as do not depart from the true spirit and script of the invention.

What is claimed as new and desired to be secured by Letters Patent of the United States is:

1. For use in a switching device, a clamping device for yieldingly securing an arc chute cover to a base of the switching device, comprising:

a first resilient element; and a second resilient element connected to said first resilient element;

wherein said first resilient element and said second resilient element have different resiliency characteristics.

2. A clamping device according to claim 1, wherein: said first resilient element is a coil spring and said second resilient element is a rubber element.

3. A clamping device according to claim 2, wherein said clamping device is a fastener having a shaft portion, and said rubber element is a cylindrical rubber bushing aligned around said shaft having an inner diameter greater than the outer diameter of said shaft, and an outer diameter, whereby when compressed said inner diameter decreases and contacts said shaft around which it is aligned and said outer diameter increases and contacts a side of the arc chute cover.

4. A clamping device according to claim 3, wherein said coil spring and said rubber bushing are aligned around and connected together upon said fastener shaft portion.

5. A clamping device according to claim 3, wherein in said fastener is a quick release fastener.

6. A clamping device according to claim 4, wherein said fastener is a quick release fastener.

7. A clamping device according to claim 2, wherein said rubber element is made from silicone rubber.

8. A clamping device according to claim 4, wherein said rubber bushing is made from silicone rubber.

9. A clamping device according to claim 2, wherein said rubber element is drum-shaped on the outside.

10. A mounting apparatus for use with switching devices comprising:

at least one mounting hole in said base;

an arc chute cover aligned upon said base;

at least one cut-out in said arc chute cover aligned with said at least one mounting hole;

at leat one fastener having a head portion and a shaft portion aligned with said cut-out and said hole;

a first resilient means aligned around said shaft;

a second resilient means aligned around said shaft, connected to said first resilient means and having a different resiliency characteristic therefrom; whereby said fastener goes through said cut-out and into said mounting hole thereby yieldingly securing said cover to said base.

* * * * *